US006401571B1

(12) United States Patent
Schuman

(10) Patent No.: US 6,401,571 B1
(45) Date of Patent: Jun. 11, 2002

(54) LAMP MODULE REMOVAL AND INSTALLATION TOOL

(75) Inventor: Robert J. Schuman, Kings Park, NY (US)

(73) Assignee: Smiths Industries Aerospace & Defense Systems, Inc., Grand Rapids, MI (US)

( * ) Notice: Subject to any disclaimer, the term of this patent is extended or adjusted under 35 U.S.C. 154(b) by 0 days.

(21) Appl. No.: 09/865,654

(22) Filed: May 25, 2001

Related U.S. Application Data

(60) Provisional application No. 60/256,186, filed on Dec. 15, 2000.

(51) Int. Cl.[7] ..... B25B 23/16
(52) U.S. Cl. ..... 81/53.1; 81/52
(58) Field of Search ..... 81/53.1, 53.2, 81/52

(56) References Cited

U.S. PATENT DOCUMENTS 4,582,352 A * 4/1986 Filter et al. ..... 294/19.1
4,631,986 A * 12/1986 Dillabough ..... 81/53.2
4,852,925 A * 8/1989 Lodin ..... 294/2
5,394,313 A * 2/1995 Dezelan et al. ..... 362/119
5,823,073 A * 10/1998 Tickner ..... 81/53.11
6,167,602 B1 * 1/2001 Yang et al. ..... 29/278

* cited by examiner

*Primary Examiner*—Joseph J. Hail, III
*Assistant Examiner*—David B. Thomas
(74) *Attorney, Agent, or Firm*—Varnum, Riddering, Schmidt & Howlett LLP

(57) ABSTRACT

A tool, specifically adapted for inserting a lamp module in a lamp module receptacle and for removal of a lamp module from a receptacle, is provided with a longitudinally extending handle having opposite ends and a lamp removal head at one end of the handle for engaging the head of a lamp tether and disconnecting the tether head from a tether rail, and a lamp insertion head at an opposite end of the handle to facilitate engagement of a lamp tether head with a tether rail in a lamp receptacle.

14 Claims, 7 Drawing Sheets

LAMP MODULE REMOVAL AND INSTALLATION TOOL

This application claims priority from provisional application Ser. No. 60/256,186, filed Dec. 15, 2000.

BACKGROUND OF THE INVENTION

1. Field of the Invention

The invention relates to hand-held instruments and more particularly to hand-held instruments for removal and installation of lamp modules provided with a tether for engaging a rail of a lamp module receptacle.

2. Description of Related Art

Certain lamp arrays for use, for example, in caution light panels used in aircraft, are compactly constructed to minimize space requirements and must be accessible to allow replacement of the defective lamp modules. A typical lamp display panel is approximately four inches square and may have receptacles for accommodating up to 32 lamp modules. Each lamp module is provided with a tether to facilitate handling of the lamp module during installation and removal. Such a tether typically has one end connected to the lamp module and an opposite, free end provided with a head. Each receptacle is provided with a tether rail for engaging the tether head. Replacement of the lamp module requires removing the lamp module from the lamp socket, disconnecting the tether head of the lamp module from the tether rail, attaching the tether head of a replacement lamp module to the tether rail and inserting the replacement module in the receptacle. One of the difficulties in replacing the lamp module is due to the fact that a disconnecting of the tether head from the tether rail during removal of an existing lamp module often results in a bending or other distortion of a tether rail. Another problem encountered in the prior art is the difficulty of handling a small replacement lamp module, particularly when the module has to be replaced with the matrix not removed from the aircraft, and the difficulty of connecting the tether head to the rail inside the lamp socket.

SUMMARY OF THE INVENTION

These and other problems of the prior art are alleviated in accordance with the present invention by a hand tool designed to facilitate engaging the tether of a replacement lamp module with the rail of a lamp receptacle. The tool includes a handle extending in a first direction and a head connected to one end of the handle and provided with a cavity for receiving the head of the tether and extending in a direction substantially perpendicular to the first direction. Advantageously, the tool allows the head of the tether to be readily inserted in the cavity and to be placed in engagement with the rail.

Advantageously, the handle allows the cavity and a second opening for engaging the rail of the lamp receptacle. In another embodiment of the invention, the tool is further provided with a second head for disengaging the head of the tether from the rail. In accordance with an aspect of the invention, the first head is adapted for straightening the tether rail in the lamp receptacle while engaging the tether to the rail.

DETAILED DESCRIPTION

Figure 1:
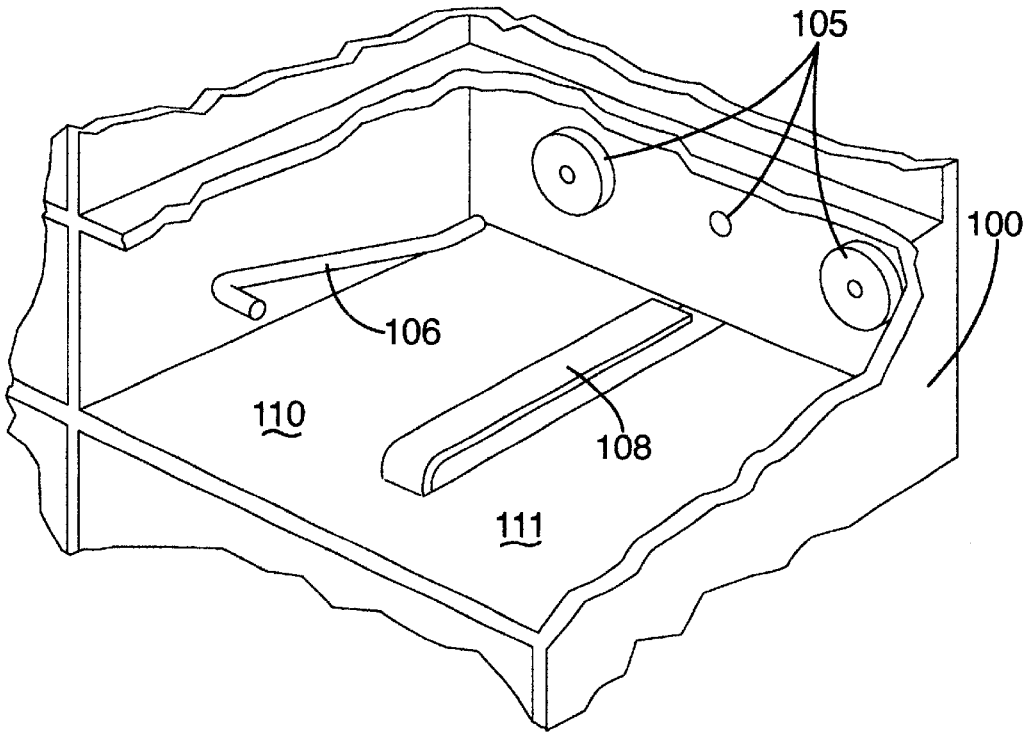
Fig. 1 (Prior Art)
FIG. 1 is a partial cutaway perspective view of a cavity of a prior art lamp display panel.

The partial cutaway view of FIG. 1 shows a receptacle 100 of a typical prior art lamp display panel having a plurality of such receptacles. The receptacle 100 is provided with a cavity 110 provided with a lower panel 111 for supporting a lamp module in the cavity. Electrical contacts 105 are provided for supplying electrical power to a lamp module and a latching spring 106 serves to engage and retain the lamp module. The cavity is further provided with a rail 108 for engagement with a tether of a lamp module to be mounted in the cavity.

Figure 2:
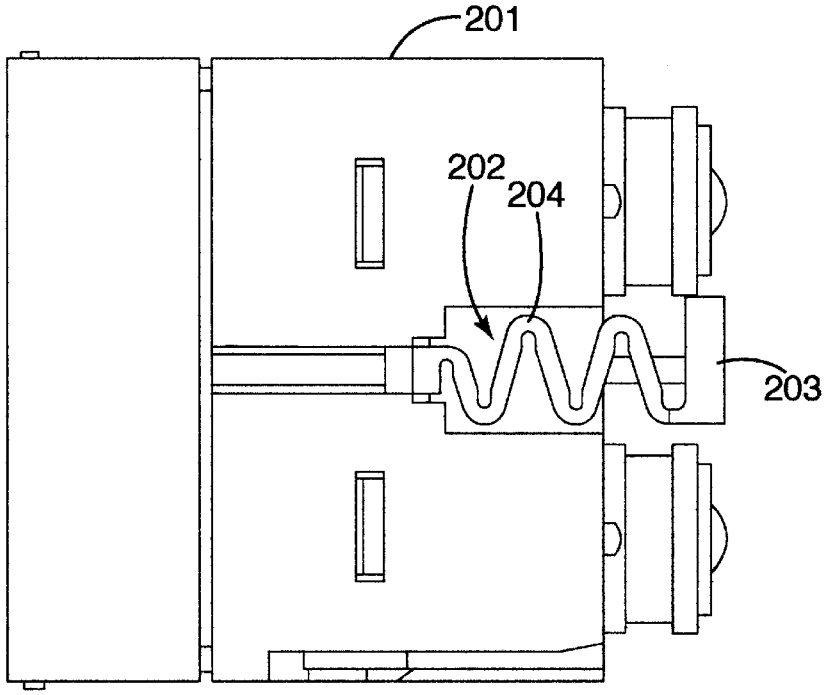
Fig. 2 (Prior Art)
FIG. 2 is a bottom view of a prior art lamp module for use in the display panel of FIG. 1.
Figure 3:
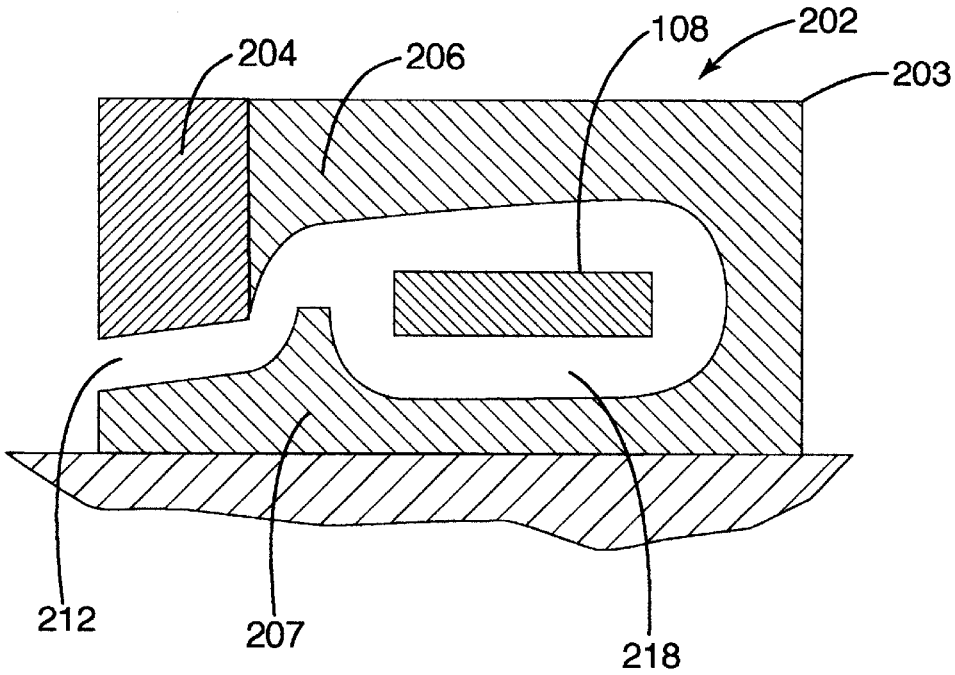
Fig. 3 (Prior Art)
FIG. 3 is an enlarged partial cross-sectional view of a rail disposed in the cavity of FIG. 1 engaging the head of a tether of the lamp module of FIG. 2.
Figure 4:
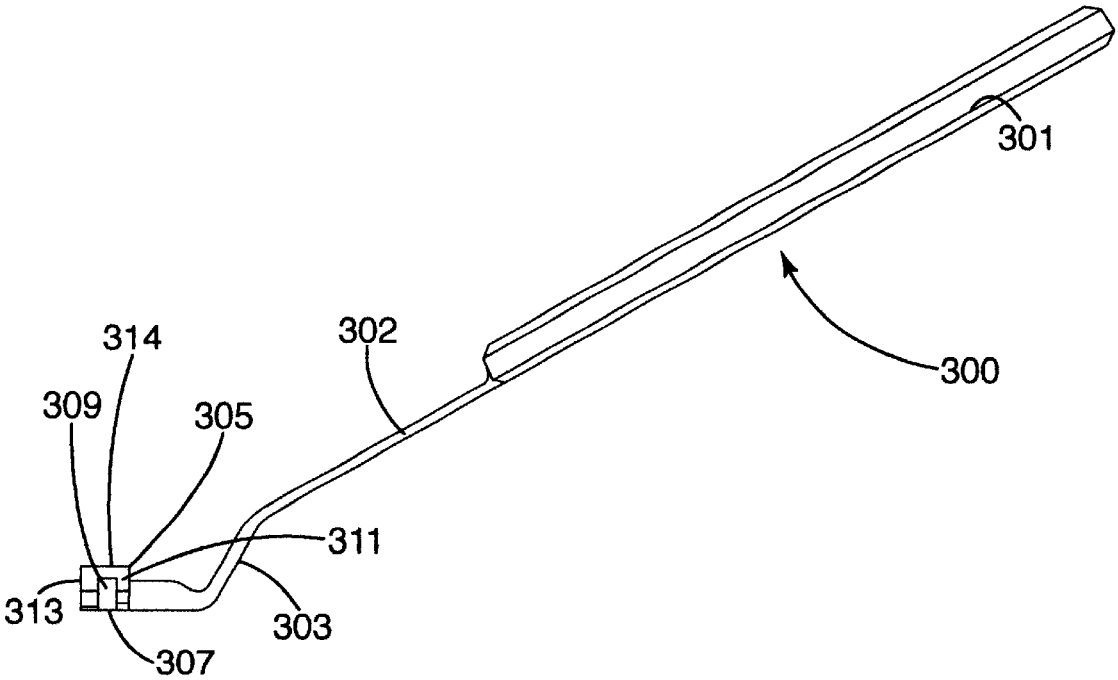
FIG. 4 is a side elevational view of a module insertion tool in accordance with the invention.
Figure 5:
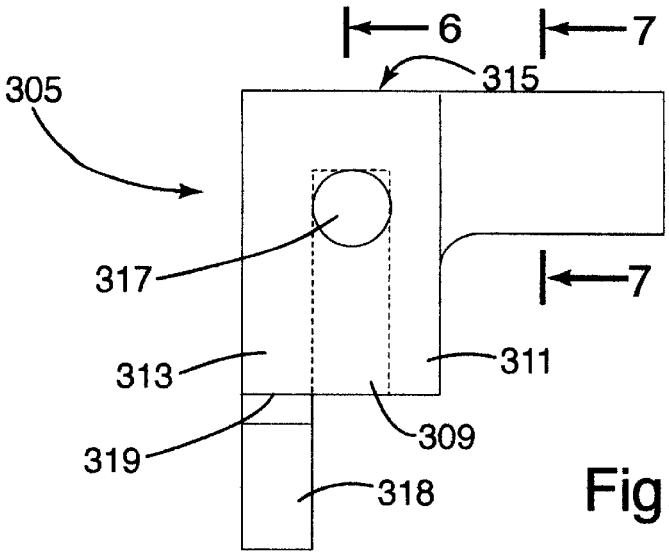
FIG. 5 is an enlarged plan view of the head portion of the tool of FIG. 4.
Figure 6:
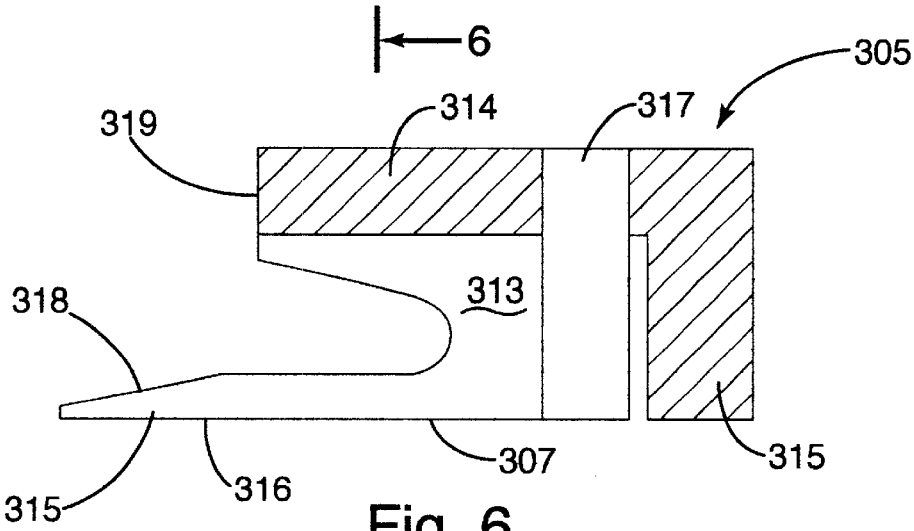
FIG. 6 is a cross-sectional view of the head of portion FIG. 5 along line 6—6.
Figure 7:
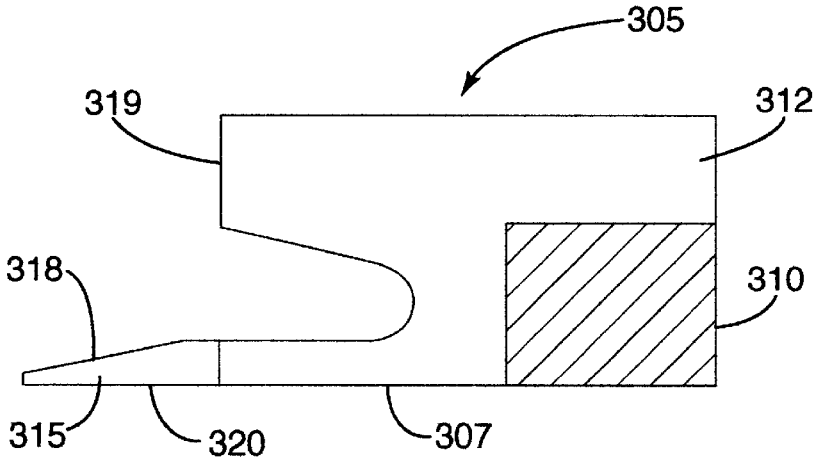
FIG. 7 is a cross-sectional view of the head portion of FIG. 5 along line 7—7.

Referring now to FIGS. 1 through 4, there is depicted in FIG. 2 a bottom view of a prior art lamp module 201 including a tether 202. The tether 202 is includes a head 203 typically made of a flexible material attached to a flexible lead 204. The head 203 is provided with a cavity 210 and a channel opening 212 allowing the head 203 to engage the rail 108, in order to prevent an unintentional removal of the lamp module from the receptacle 100. In FIG. 3, the head 203 of the tether 202 is shown engaging the rail 108 in a typical prior art fashion. Rail 108 and the shaft 204 of the tether 202 are shown in cross-section in FIG. 3. FIG. 4 provides a side elevational view of a module insertion tool according to the invention. The tool 300 is specifically designed for inserting a light module, such as the module 201 shown in FIG. 2, into a cavity, such as the cavity 110 shown in FIG. 1. More particularly, the tool is specifically adapted to provide proper engagement between the head 203 of the tether 202 of lamp module 201 and the rail 108 of a lamp receptacle 100, while serving to straighten the rail 108. As shown in FIG. 4, the tool 300 is provided with a handle 301 having extensions 302 and 303 connecting to a head 305. The head 305 is provided with a substantially flat base surface 307 for engaging the lower panel 111 of the receptacle 100. The head 305 is further provided with an opening 309 for receiving the head 203 of the tether 202. In one preferred embodiment of the invention, the extension 303 extends at an angle of approximately 60 degrees to the flat base surface 307 and the extension 302 extends at an angle of approximately 30 degrees to the flat base surface 307.

Figure 8:
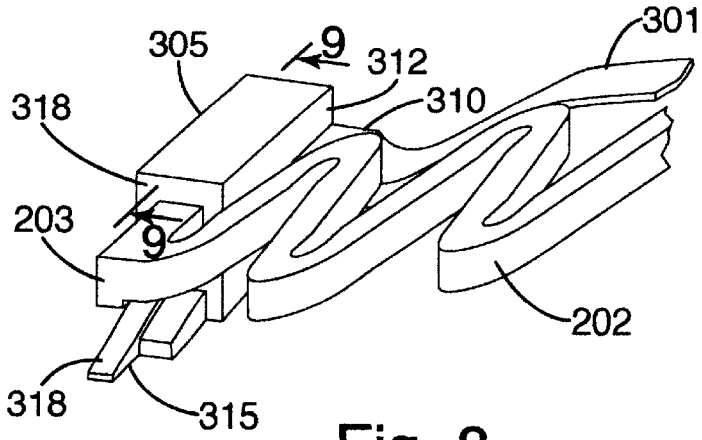
FIG. 8 is a partial cut-away perspective view of the tool of FIG. 4 engaging the head of a tether.
Figure 9:
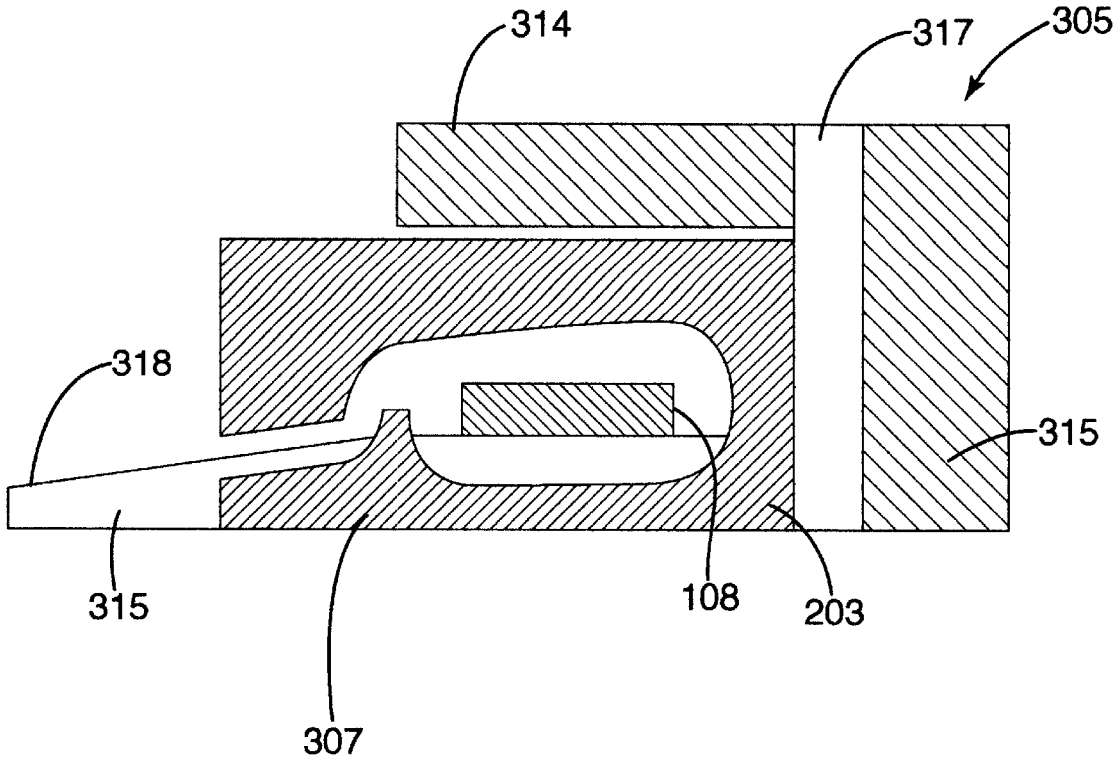
FIG. 9 is a cross-sectional view of the tool of FIG. 8 along line 9—9.

Referring now to FIGS. 1 through 9, the opening 309 in head 305 is preferably a channel shaped opening bounded by vertically extending, opposing side walls 311, 313, an upper wall 314 and a rear wall 315. A vertically extending pin 317 is disposed in the channel shaped opening extending in a direction substantially perpendicular to the flat base surface 307. The pin 317 is preferably press-fit in the head 305 and serves as a stop for the terminal end of the head 203 of the tether 202, when the tether head 203 is fully inserted in the head 305, as depicted in FIG. 8. The flat base surface 307 of the head 305 is provided with an extension 315. The extension 315 has a substantially flat bottom surface 316 and a sloping top surface 318. The extension 315 is adapted to extend under the rail 108 in the cavity 110 and serves to straighten the rail 108 when the tool is used to install a lamp module in the cavity 110. The sloping surface 318 preferably terminates a pre-defined distance beyond the vertical end surface 319 of the head 305 to facilitate insertion of the extension 315 under the rail 108 and engagement of the head 203 with the rail 108, as depicted in FIG. 9. During the tether installation process, the head 305 of the tool 300 is preferably moved along a substantial portion of the rail 108 forcing the extension 315 against the rail 108, thereby tending to straighten the rail 108. In this manner, the lamp module installation tool of this invention serves to facilitate installation of lamp modules in a lamp receptacle.

Figure 10:
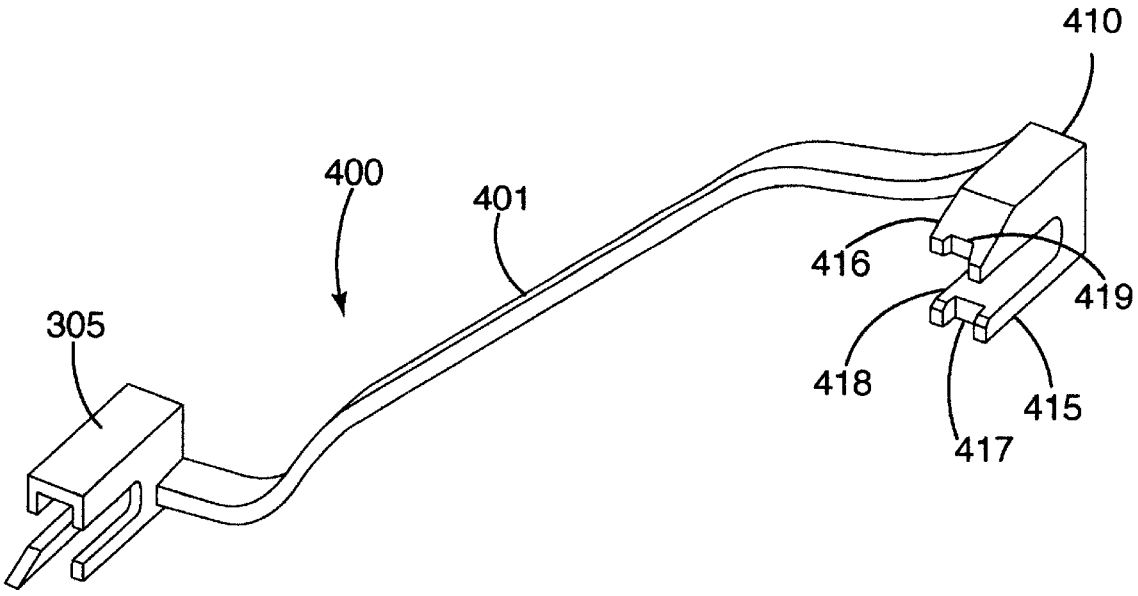
FIG. 10 is a perspective view of combination module removal and installation tool in accordance with one aspect of the invention.

Referring now to FIGS. 1, 3 and 10, FIG. 10 depicts a tool 400 having a handle 401 and having a first head 305 at one end and a second head 410 at another end of the handle, opposite the one end. The head 305 serves primarily as a tether installation tool, as described above with respect to FIGS. 1 through 9. The head 410 is specifically adapted to be used to disengage the head 203 of the lamp tether from the rail. The head 410 is provided with a base portion 415 and an upper portion 416, disposed opposite the base portion 415. The head 410 is further provided with a slotted opening 418 extending between the base portion 415 and the upper portion 416. The slotted opening 418 is provided to engage the head 410 with the rail 108. A direct push against the tether open end with the groove 417, of head 410 causes the head 203 to become disengaged from rail 108. The upper portion 206 of the head 203 is spaced apart from the lower portion 207 to facilitate removal of the head 203 from the rail 108.

The head 410 is further provided with aligned slotted openings 417,419 extending through the lower portion 415 and upper portion 416, respectively and extending in a direction perpendicular to the slotted opening 418. The slotted openings 417, 419 are provided to allow the head 410 to be used for containing the end face where slot 212 is located, which tends to be distorted in the head removal process. The rail 108 is straightened by sliding the slotted aligned openings 418 along the length, or a portion of the length, of the rail 108. Slot 415 provides a place for rail to be as the head 206 is pushed away from the rail 108.

Figure 11:
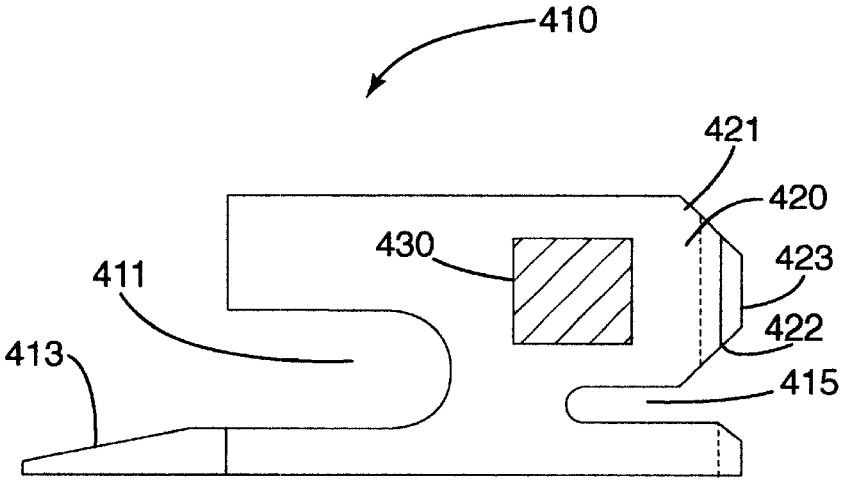
FIG. 11 is a side elevational view of a combination tether installation and removal head.
Figure 12:
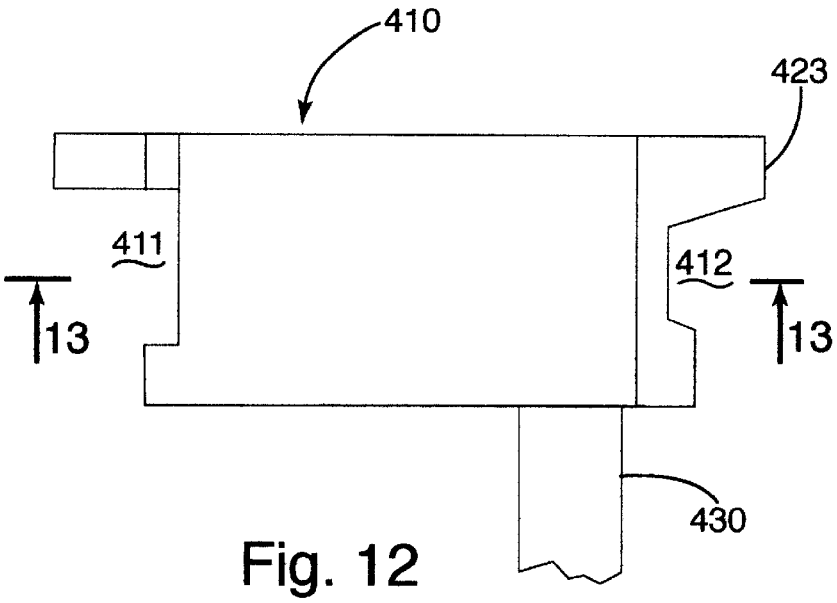
FIG. 12 is a top elevational view of the head of FIG. 11.
Figure 13:
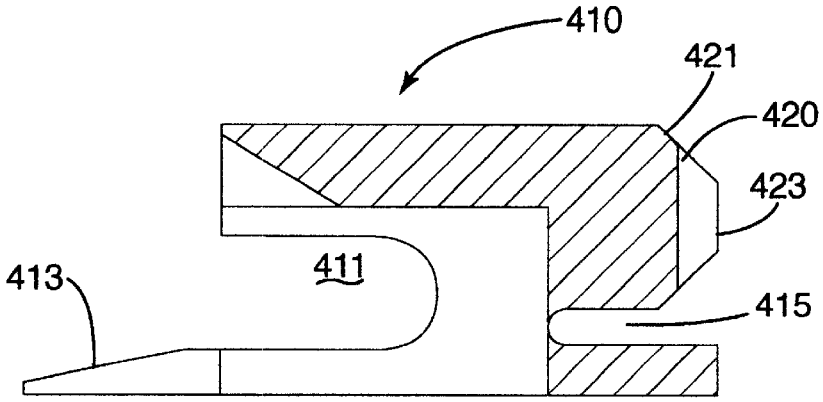
FIG. 13 is a cross-sectional view of the head of FIG. 12 along the line 13—13.

FIGS. 11 through 13 depict a head 410 as an alternate embodiment of the head 305 of the tool of FIGS. 4 through 10. The head 410 is shown in a side elevational view in FIG. 11, in a top view in FIG. 12 and in cross-section in FIG. 13. The head 410 differs from the head 305 (FIGS. 4 through 9) in that the head 410 is a combination tether installation and removal head. The head 410 is provided with a handle 430 (shown in cross-section), similar to handle 300 shown in FIG. 4, and with an end portion 420 having sloping surfaces 421, 422. The end portion 420 is provided to facilitate engagement with the tether head 203 of a lamp module 201 (FIGS. 2 and 3). As shown in FIGS. 11 through 13, the end portion 420 is provided with sloping surfaces 421, 422 and a vertically extending end surface 423 adjacent a cavity 412. The cavity 412 is adapted to engage the tether head 203 of the tether 202. A further opening 415 is provided to allow the head to also be used for straightening of the rail 108.

Figure 14:
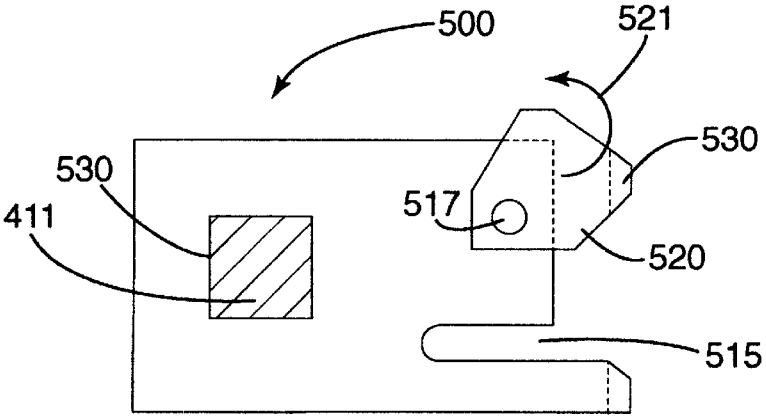
FIG. 14 is an alternate embodiment of a module removal head.
Figure 15:
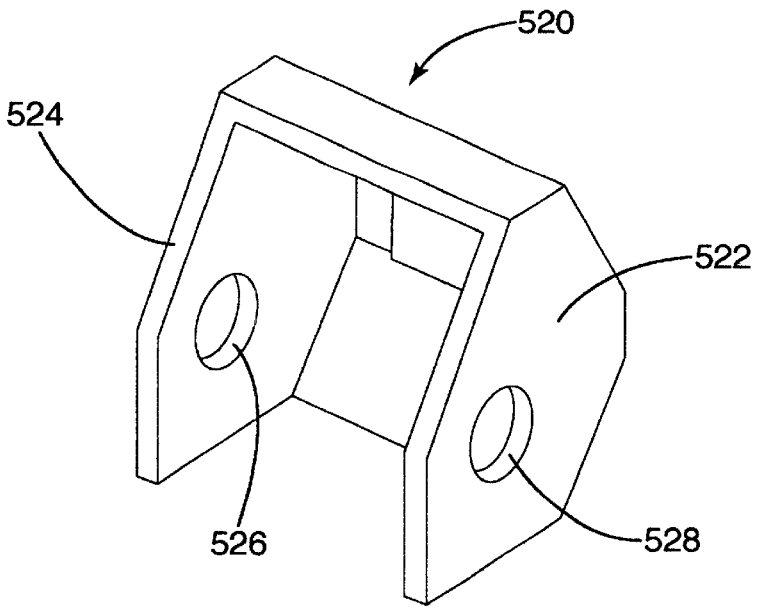
FIGS. 15 and 16 are perspective views of a cap portion of FIG. 14.
Figure 16:
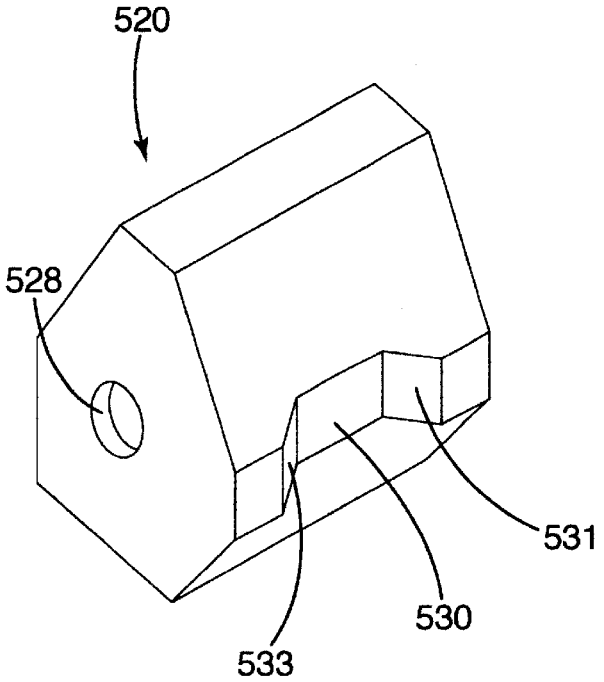

FIG. 14 depicts an alternate embodiment of a head 500 of a lamp module removal tool, such as the tool 400. The head 500 is provided with a slotted opening 515, serving the same purpose as the slotted opening 415 in the tool head 410, namely, to serve for straightening of the rail 108. The head 500 is further provided with a pivoting end cap 520, pivoting about a pivot pin 517. The end cap 520, like the end portion 420 of the head 410, serves to engage the head tether head 203. The pivoting end cap 520 rotates in the direction indicated by the arrow 521, to further facilitate removal of the lamp unit 201 from the receptacle 100. FIG. 15 is a left side perspective view of the pivoting end portion 520 and FIG. 16 is a right side perspective view of the pivoting end portion 520. As depicted in FIGS. 14 through 16, the cap 520 is provided with an indented area 530 defined by sloping side walls 531 and 533. The indented area is provided to facilitate engagement with the tether head.

What is claimed is:

1. A tool for inserting a lamp module provided with a tether comprising a tether head into a lamp receptacle comprising a rail, said tool comprising:

a longitudinally extending handle extending in a first direction and having a distal end; and a head disposed on said distal end and comprising a frontal wall and a longitudinally extending cavity in said frontal wall for receiving said tether head;

said cavity extending in a second direction extending substantially perpendicularly to said first direction.

2. The tool in accordance with claim 1, wherein said head further comprises an extension extending from said frontal wall and wherein said extension has a sloping upper surface and a lower surface.

3. The tool in accordance with claim 2, wherein said head further comprises a lower surface and said extension comprises a distal end and wherein said lower surface of said extension extends from said frontal wall to said distal end of said extension in substantial alignment with said lower surface of said head of said tool.

4. The tool in accordance with claim 3, wherein said sloping upper surface slopes upwardly from said distal end of said extension toward said frontal wall.

5. The tool in accordance with claim 4, wherein said frontal wall has a predetermined width and said extension extends from a portion of said width of said frontal wall.

6. The tool in accordance with claim 1 wherein said head further comprises a lower surface and said handle extends at a predetermined angle to said lower surface of said head.

7. The tool in accordance with claim 4 wherein said handle comprises a first portion disposed adjacent said head and extending at said predetermined angle and a second portion extending between said first portion and said head, and wherein said second portion extends from said head at angle to said lower surface of said head differing from said predetermined angle.

8. The tool in accordance with claim 6 wherein said first predetermined angle is greater than said second predetermined angle.

9. The tool in accordance with claim 1 and further comprising a pin disposed in said cavity and extending a direction substantially parallel to said frontal wall.

10. The tool in accordance with claim 1 wherein said head further comprises a rear wall disposed opposite said frontal wall and a slotted opening in said rear wall extending toward said frontal wall.

11. The tool in accordance with claim 10 wherein said head further comprises a lower surface and wherein said slotted opening extends in a direction substantially parallel to said lower surface and toward said frontal wall.

12. The tool in accordance with claim 1 wherein said head further comprises a rear wall, opposing side walls and an upper wall, and wherein said rear wall is disposed opposite said frontal wall and said opposing side walls extend between said frontal wall and said rear wall and said upper wall extends between said side walls, and wherein said head further comprises a cavity in said rear wall extending in a direction substantially perpendicular to said rear wall, said cavity having a center portion and sloping side walls extending at a predetermined angle from said center portion toward said side walls.

13. The tool in accordance with claim 12 wherein said side walls of said cavity each comprise a sloping upper portion sloping in direction extending from said rear wall toward said upper wall.

14. The tool in accordance with claim 13 wherein said rear wall further comprises a sloping lower portion sloping in a direction extending from said rear wall toward said lower wall.

* * * * *